US005996467A

United States Patent [19]

Churgay et al.

[11] Patent Number: 5,996,467

[45] Date of Patent: Dec. 7, 1999

[54] POLYMER-METAL COATINGS FOR SWASHPLATE COMPRESSORS

[75] Inventors: Jon R. Churgay, Northville; Feng Bin, Farmington Hills, both of Mich.

[73] Assignee: Ford Motor Company, Dearborn, Mich.

[21] Appl. No.: 09/144,482

[22] Filed: Aug. 31, 1998

[51] Int. Cl.[6] ..... F01B 3/00

[52] U.S. Cl. ..... 92/71; 91/499; 252/30; 428/328

[58] Field of Search ..... 92/12.2, 71; 91/499; 428/421, 422; 384/908, 909

[56] References Cited

U.S. PATENT DOCUMENTS

| | | | |
|---|---|---|---|
| 3,908,038 | 9/1975 | Nienart et al. | 427/485 |
| 4,196,249 | 4/1980 | Patrichi . | |
| 4,208,472 | 6/1980 | Cho et al. . | |
| 4,503,179 | 3/1985 | Yoshimura et al. . | |
| 4,666,787 | 5/1987 | Bickle et al. | 428/550 |
| 4,732,818 | 3/1988 | Pratt et al. . | |
| 4,847,135 | 7/1989 | Braus et al. | 428/138 |
| 4,892,669 | 1/1990 | Marcora et al. | 252/30 |
| 5,056,417 | 10/1991 | Kato et al. | 92/71 |
| 5,486,299 | 1/1996 | Fuwa et al. | 252/12 |
| 5,573,846 | 11/1996 | Harig et al. | 428/323 |
| 5,655,432 | 8/1997 | Wilkosz et al. | 91/71 |
| 5,686,176 | 11/1997 | Adam et al. | 428/327 |
| 5,700,093 | 12/1997 | Hiramatsu et al. | 384/276 |

FOREIGN PATENT DOCUMENTS

| | | |
|---|---|---|
| 60-22080 | 2/1985 | Japan . |

*Primary Examiner*—John E. Ryznic
*Attorney, Agent, or Firm*—Lorraine S. Melotik

[57] ABSTRACT

A swashplate type compressor having a cylinder block with cylinder bores disposed parallel to the axis of the cylinder block. A rotary shaft rotatably mounted within the cylinder block carries an aluminum or iron alloy swashplate. The swashplate is fixed in the rotary shaft and has two facial surfaces and an end surface. The swashplate has a coating of a thermoset composite material which is polymer based and includes 1–20 volume percent metal particles. The metal particles are selected from Cr, Ni, Fe, Cu, Mo, Al or a mixture of any of them or their alloys. The polymer portion of the composite comprises 3–20 volume % PTFE and resin binder therefor.

9 Claims, 1 Drawing Sheet

POLYMER-METAL COATINGS FOR SWASHPLATE COMPRESSORS

FIELD OF THE INVENTION

The present invention relates to a swashplate type compressor for compressing a refrigerant gas, by rotating a swashplate. More particularly, the present invention relates to an improvement to swashplate compressors by applying a coating of a material, which is a composite of polymer and metal particles, on swashplate surfaces to reduce friction and improve seizure resistance on the components. The swashplate body may be aluminum alloy or iron alloy.

BACKGROUND OF THE INVENTION

Conventionally, a swashplate type compressor is used in systems such as an air conditioning system of an automobile. According to a known swashplate type compressor, the transmission of motive power is carried out, as a swashplate and a piston reciprocate, thereby suctioning, compressing and discharging the gas. The swashplate is usually composed of aluminum or iron alloy and shoes, which make slideable contact with the swashplate when it rotates, are composed of iron or copper alloys. The metal on metal contact at the shoe and swashplate interface requires special precautions to be taken in order to prevent undue wear and possible seizure of the shoe with the swashplate.

Lubrication in the swashplate type of compressors is critical to their reliability, especially at the swashplate sliding surface. During the service life of the compressors, the swashplate surface may encounter low lubricant supply. Sometimes a compressor may even run with no lubricant at all for a short period, which can result in swashplate damage or, in extreme situations due to the generation of significant heat, compressor seizure. A good countermeasure to this problem has been to apply lubricious coatings on swashplates.

For example, U.S. Pat. No. 5,056,417 treats a swashplate body with a surface coating layer made of tin and at least one metal selected from the group consisting of copper, nickel, zinc, lead and indium. In patent application U.S. Ser. No. 08/050,215, filed Mar. 30, 1998 and commonly assigned herewith, a tin/cobalt coating is disclosed which has improved wear resistance and also excellent adhesion to the swashplate.

Polymer based coatings have also been suggested for coating aluminum swashplates. U.S. Pat. No. 5,655,432 treats a swashplate with a coating of a mixture of cross-linked polyfluoro-elastomer bonded directly to the aluminum, a lubricious additive and a load bearing additive like boron carbide. The part is masked to apply the coating in only certain areas. Sho 58-129646 discloses a swashplate coated with a solid lubricant such as boron nitride, fluorine resin solidified with resin. It also discloses coating with soft metals like tin and lead. Polymer based coating, while providing excellent friction reduction and seizure resistance at dry condition, have less than desirable wear resistance (durability) due to the physical characteristics of the polymers. That is, they are soft compared to the counterparts they contact, normally ferrous metals, and become even softer at higher temperatures. Because of this, polymer coatings have not found commercial acceptance as lubricious coatings for aluminum swashplates.

The present invention overcomes the deficiencies of other swashplate coatings by providing a coating with excellent wear resistance, low sliding friction and additionally good thermal conductivity.

SUMMARY OF THE INVENTION

The invention is a swashplate type compressor comprising a cylinder block having a cylinder bore disposed parallel to the axis of the cylinder block. A rotary shaft is rotatably mounted within the cylinder block and a swashplate is fixed to the rotary shaft for rotation with the rotary shaft within the cylinder block. A piston is reciprocally fitted in the cylinder bore. Shoes slideably intervene between the piston and the swashplate. The swashplate comprises a matrix composed of aluminum or iron alloy and includes, on at least a part of the swashplate surface, a coating layer comprising a thermoset polymer-metal composite. The coated part of the surface of the swashplate is in slideable contact with the shoes. The thermoset polymer-metal composite coating comprises: (1) 3–20 volume % polytetrafluoroethylene (PTFE), (2) 60–92 volume % resin binder, and (3) 1–20 volume % metal particles selected from the group consisting of chromium, iron, nickel, copper, molybdenum, aluminum and their alloys or mixtures, each volume percent being based on the total volume of the composite coating. The cured (thermoset) composite coating has a hardness of more than 6H using the pencil scratch test.

Advantageously, the coating not only provides a surface which has low friction and non-stick features due to the PTFE component, it has sufficient hardness which increases wear resistance, attributable in part to the metal particles. Another important advantage of the invention coating is that the metal particles provide thermal conductivity to the coating. This allows heat to be removed away from the swashplate surface during its operation. In contrast, simple polymeric coatings are limited in this ability.

As a result of this invention, the coated swashplate will have better wear resistance, higher thermal conductivity and excellent anti seizure capability at no/low lubrication.

DETAILED DESCRIPTION OF THE PREFERRED EMBODIMENTS

Figure 1:
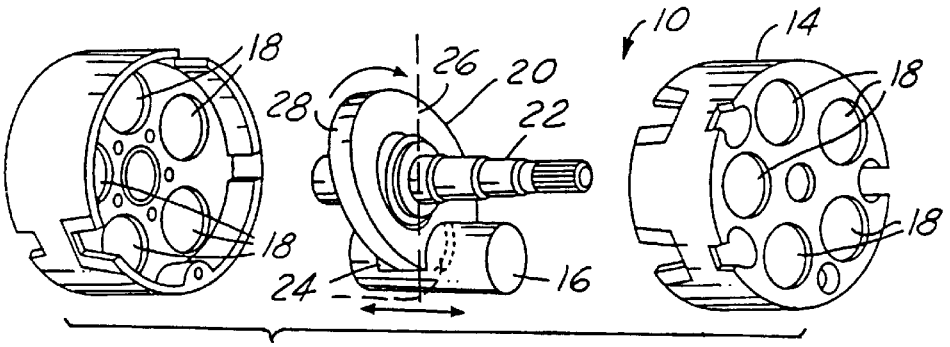
FIG. 1 is an exploded view of a swashplate compressor according to an embodiment of the present invention.

Illustrated in FIG. 1 is a perspective and exploded view of an automotive swashplate type compressor 10 for propelling refrigerant gas through a cooling circuit. The compressor 10 comprises a two-piece cylinder block 12, 14 which is provided with a plurality of reciprocating pistons 16. For clarity, FIG. 1 depicts only one of such reciprocating piston 16. In practice, each piston 16 reciprocates within cylinder bore 18.

Each piston 16 is in communication with the swashplate 20 which is fixably mounted on an axially extending rotateable shaft 22. The reciprocating motion of each piston 16 within its associated cylinder bore successively siphons, compresses, and discharges refrigerant gas. A pair of pivoting shoes 24 are positioned between each piston 16 and swashplate 20. The shoe 24 transfers the rotational motion of the swashplate 20 to the linear motion of the piston 16. The swashplate 20 has two facial surfaces 26 (only one shown for clarity) which contact the shoe 24.

Rotation of the shaft 22 causes the swashplate 20 to rotate between the cylinder blocks 12, and 14. The facial surfaces 26 contact the shoes 24 and are subjected to a shear-type frictional contact with shoe 24. An end surface 28 may contact the piston 16 if the piston 16 is slightly skewed or bent. As discussed above, the facial surfaces 26 and generally also end surface 28 and are provided with a coating to prevent wear of the swashplate surfaces which may result from contact with piston 16 and shoes 24. As would be appreciated, this coating should also have a low coefficient of friction to increase the efficiency of the compressor.

The shape of swashplate 20 according to the present invention may be the same as those of the conventional swashplates. The material composing the matrix of swashplate body 20 is an aluminum alloy or an iron alloy. The aluminum alloy can be, for example, aluminum-high-silicon type alloy, aluminum-silicon magnesium type alloy, aluminum-silicon-copper-magnesium type alloy and, aluminum alloys containing no silicon.

Swashplate 20 is usually made from an aluminum alloy material to make it light-weight and strong. Aluminum alloys containing hypereutectic silicon, that is more silicon than is required to form a eutectic crystalline structure, are often used. The swashplate alloy generally includes hard grains. As used herein, "hard grains" means grains having average particle diameters of 20 through 100 micrometer and a hardness greater than 300 on the Vickers hardness scale or, more preferably, having a hardness greater than 600 on the Vickers hardness scale, such as a primary crystal silicon. Because Al—Si alloy generally contains about 13% to 30% by weight of silicon, meaning that Al—Si alloy contains more silicon than is required to form a eutectic crystal structure, Al—Si alloy has primary crystal silicon dispersed in the matrix structure. Also Al—Si hypereutectic alloy has superior characteristics and could withstand very severe sliding operations at the swashplate. While the surface coating 30 of the present invention may be used with hypereutectic aluminum-silicon alloy, it is also advantageous for use on non-hypereutectic aluminum alloys having less than 12.5% by weight of silicon because this material allows for easy machining. Other aluminum alloy materials having the hard grains and possibly applicable to swashplate body 20 are the intermetallic compounds of: aluminum-manganese; aluminum-silicon-manganese; aluminum-iron-manganese; aluminum-chromium and the like.

If not for a coating layer on the swashplate, the swashplate body 20 which is often made of aluminum alloy directly contacts shoes 24. However, according to the present invention, during operation surface a coating layer 30 is present on swashplate body 20 and it contacts shoes 24 so that the frictional resistance with the shoes is greatly reduced.

Figure 2A:
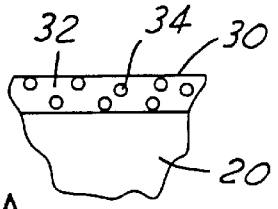
FIG. 2A is an enlarged view of the encircled area of FIG. 2.
Figure 2:
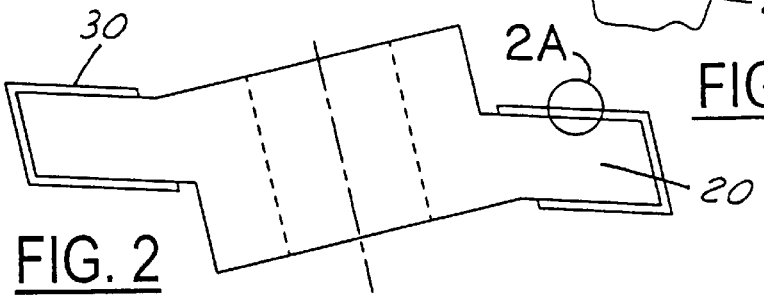
FIG. 2 is a schematic of a swashplate surface with an embodiment of the polymer-metal composite coating of the present invention.

According to the present invention, the surface coating layer 30 in FIG. 2 is formed on the surface of swashplate body 20 at least on the part of the surface having slideable contact with shoes 24. While the greatest benefit is obtained from coating at least facial surface 26 having contact with shoes 24, also coating swashplate side surface 28 can simplify the manufacturing process. And it also reduce the friction between surface 28 and the bridge surface on part 16 which contacts surface 28. The surface coating layer 30 may hence be formed over the whole surface of the swashplate body 20. As discussed above, the surface coating layer 30 acts to reduce frictional resistance with shoes 24 and prevents the occurrence of seizure at the sliding facial surface 26 of the swashplate 20, e.g., when there is no lubrication temporarily at these sites.

The present invention surface coating layer 30 is a thermoset polymer-metal composite coating. The composite coating is a polymer based composite, the polymer component of the composite comprising 3–20 volume % polytetrafluoroethylene (PTFE) and 60–92 volume % resin binder, based on the total volume of the composite. The polymer portion of the coating composite 30 is shown as 32 in FIG. 2A. The composite coating 30 includes 1–20 volume % of metal particles shown as 34 in FIG. 2A, the volume % of metal particles also being based on the total volume of the composite coating. Preferably, the composite coating comprises 1–18 volume % metal particles, more preferably being about 2–10 volume % of the coating. On average, optimally the metal particles have a diameter of 1–20 $\mu$m.

The metal particles are selected from the group consisting of chromium, iron, nickel, copper, molybdenum, aluminum and their alloys or mixtures, i.e., mixtures of any of the metals or their alloys. The particles, in one embodiment, are a mixture of iron particles and chromium particles.

The PTFE used in the thermoset composite coating of the present invention is a material well known in the art. It provides low friction and non-stick features to the coating. Any resin binder can be used with the PTFE to form a thermoset polymer coating upon curing, generally at highly elevated temperatures, as long as it provides the requisite 6H hardness (as measured by the pencil scratch test) to the coating. Exemplary of such resin binders are phenolic, epoxy or polyamide-imide resins, the latter being preferred. This is because it can maintain a higher hardness at a relatively high temperature.

The coating composite may include further additive materials such as an adhesion modifier, solid lubricant, non-metallic hardness modifiers and corrosion inhibitor. If employed, they would optimally be included in about 0.5–20 volume % based on the total volume of the coating. Preferably, at least one of these materials are included. Exemplary of such materials are titanate adhesion modifier, graphite solid lubricant, polyphenylene sulfide (PPS) polymer hardness modifiers, and sodium nitrite corrosion inhibitor. Still other such materials will be apparent to those skilled in the art in view of the present disclosure.

According to the present invention, the cured composite coating has a hardness of more than 6H, as measured by the pencil scratch test. This test is well known in the art. One embodiment of the test involves the following steps. (1) Sharpen a series of pencils with hardness grades from 2H to 9H; (2) Scratch the coating surface with the tip of a lower grade pencil (selected based on the pre-estimate of the coating hardness) in a 30–50 degree angle and examine the surface to see if a permanent scar is generated on the coating surface. (3) If a permanent scar cannot be seen, choose another pencil with a higher grade next to the one that has just been used. (4) Continue this procedure until a scar can be generated. The hardness of the coating is classified as the same hardness of the last pencil that was able to generate a scar.

The composite coating material is made by mixing the component materials together to form a substantially homogeneous mixture. Generally, in making the composite to be coated on the swashplate the following procedure may be followed: (1) pour the mixture of PTFE and the resin binder (stored in a solvent) into a mixing can; (2) add metal particles into the can and stir the mixture until the metal particles are uniformly distributed; (3) spray the mixture to a swashplate by an air gun to form a coating layer on the swashplate surface, then let it air dry for 10 minutes; (4) bake the coated part in an oven at 480 ° F. or above for about 20–60 minutes, so that the resin will cure; (5) move the part out of the oven and let it cool down.

However, it should be appreciated that the method of making the coating can be varied to the present invention. For example, the materials excluding the resin binder may be mixed as one component and then the resin binder is mixed in just prior to use to increase the shelf stability of the composite material.

The inclusion of the metal particles in the amounts disclosed has been found to provide the excellent properties described above without degrading the low friction feature of the PTFE resin coating. The size of metal particles in the coating optimally is smaller than the coating layer thickness to obtain optimal bonding strength with the coated surface. If a low abrasion tendency is desired, the particle size is preferred to be substantially smaller than the thickness. The selection of the particular metal particles and their volume fractions in a specific coating can be determined according to the operating conditions the coating will encounter, as would be apparent to those skilled in the art in view of the present disclosure. Copper and aluminum particles, for example, are preferred if the main purpose is to improve thermal conductivity. Chromium, nickel, iron, and molybdenum are preferred if high wear resistance and high hardness are desired. Optimally, the metal particles used in the present invention have been chosen from metals which have a hardness similar to the counterpart which they are to contact in the sliding friction systems. The inventors believe that this is important because the main goal is to improve the coating's wear resistance and hardness. The polymer component alone, without adding the current metallic particles, has shown to have less than desirable wear properties in some long term compressor durability tests, especially in the high loading thrust area of the swashplate.

In the present invention, the coating may be applied in a thickness of about 5 to 50 $\mu$m, more preferably being 15 to 35 $\mu$m. This composite coating material would be applied to the swashplate surface by any of several techniques, including spraying, brushing or dipping. In case a thicker coating is needed, the spraying step, e.g., can be repeated several times. After the material is coated on to the swashplate surface it is cured by high temperature in an oven. The curing cycle in the oven can be multiple times. If desired, the swashplate surface may be treated by sand blasting, chemical etching or other methods prior to coating application. This treatment desirably provides a surface roughness level from Ra 0.3 to 4.0 $\mu$m which can aid in improving the bond strength between the coating and swashplate.

It was found by the inventor of the present invention that unexpectedly the new coating of PTFE resin plus metallic particles can reach a hardness level of 7H to 9 H that cannot be ordinarily achieved by simple PTFE resin coatings. The hard resin base gives the coating high wear resistance against the counterpart or any abrasive action, makes it durable and also supports the dispersed metallic particles better under both tangential and vertical loads compared to a soft resin base. The metal particles dispersed inside the coating are believed to increase the overall hardness of the coating and have the ability to transfer the frictional heat away from the part during operation. The metal particles on the coating surface can improve wear resistance against a hard counterpart and provide load bearing capability. However, neither the truth nor understanding is necessary for the practice of the present invention. This theory is advanced in an attempt to explain the excellent results obtained with the present invention.

According to the present invention coating, the coefficient of friction between swashplate 20 and shoe 24 is small so that the smooth sliding of shoe 24 on the swashplate 20 is ensured. The surface coating layer 30 is superior in strength thereby reducing the amount of abrasion which occurs thereon. Still further, seizure of the shoe 24 to the surface of swashplate 20 is prevented even when a liquid refrigerant is compressed or the compressor is operated under unfavorable circumstances such as a long oil return time encountered by the compressor during operation or insufficient lubrication of the sliding parts caused by leaks of refrigerant gas to the outside of the compressor.

Certain tests were performed which demonstrated the excellent wear properties of the present invention coating on compressor swashplates. The same PTFE resin matrix (10–15% PTFE, 70–80% polyamide-imide resin) was used to make various coatings with different amounts of metal particles. The results are shown below in Table 1 below in average test result values. Swashplate coating performance is given for the marginal lubrication bench test (seizure time in sec.) and the compressor high speed test (failure time in hours).

TABLE 1

| Swashplate condition | Marginal Lubrication Test (seconds) | High Speed Test (hours) |
|---|---|---|
| With PTFE resin coating | 1421 | 215 |
| With composite coating (PTFE, resin + 5% Cr particle) | 2895 | 231 |

Figure 3:
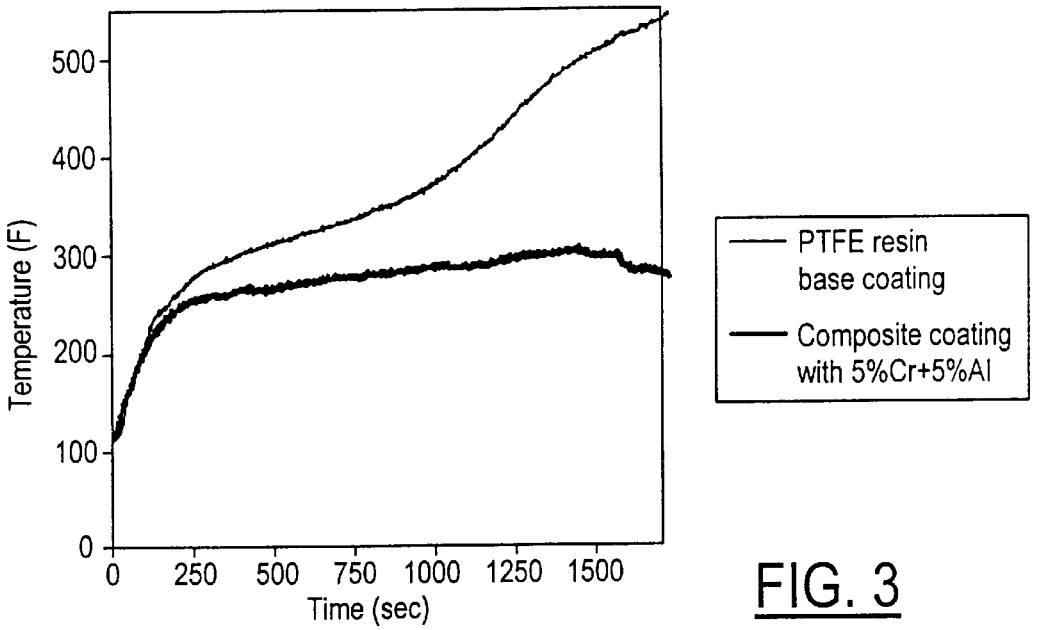
FIG. 3 is a graph showing the temperature of a swashplate coated with a present invention embodiment coating and a comparative example coating without metal particles.

It can be seen from the test results above that if a fluoropolymer (without metal particles) coating was used (comparative example), the swashplate durability was high at low/no lubrication as shown in marginal lubrication bench test, but was low in normal lubrication conditions as shown in compressor high speed test. By adding metallic particles into the fluoropolymer coating according to the present invention, the durability was significantly improved at both low and normal lubrication conditions and the swashplate temperature during testing was lowered, as shown in FIG. 3, because of the good heat conductivity of metallic particles. In particular, the graph in FIG. 3 shows the change in swashplate temperature for a swashplate coated with a comparative material: PTFE resin (not according to the present invention) and a swashplate coated with an embodiment coating of the present invention (same PTFE resin but additionally including 5% Cr and 5% Al particles) during the marginal lubrication test (stopped at 1700 seconds).

The lower temperature of the swashplate during operation in turn will aid in maintaining the integrity and hardness of the composite coating and therefore, allows compressors to run longer under the same external conditions without deteriorating the coating. In this aspect, good heat conductivity at swashplate surface plays a large role in the improvement of the compressor durability compared to the regular PTFE resin coating. This is a very important aspect and improvement provided by the present invention composite coating.

Another significant aspect of the present invention composition is the requirement that the metal particles be controlled to comprise a specific proportion of the composite coating. That is, as the metal particle volume fraction increases in the swashplate coating, the wear on the counterpart shoe is also subject to increasing wear. The optimal amount of particulate becomes more critical especially if the majority of metal particles are made of hard metal such as chromium and iron. Therefore, the proper selection of metal particle volume fraction is critical to the counterpart durability.

Consequently, by the effects described above, the swashplate compressor according to the present invention can satisfactory withstand very severe use and achieve long service life.

It will be obvious to those of skill in the art that various modifications may be made to the foregoing invention without departing from the spirit and scope of the claims that follow.

We claim:

1. A swashplate type compressor comprising:

a cylinder block having a cylinder bore disposed parallel to the axis of said cylinder block;

a rotary shaft rotatably mounted within said cylinder block;

a swashplate fixed to said rotary shaft for rotation with said rotary shaft within said cylinder block;

a piston reciprocally fitted in said cylinder bore; and shoes which slideably intervene between said piston and said swashplate wherein said swashplate comprises a matrix composed of aluminum-high-silicon type alloy which includes 13% to 30% silicon by weight and, on at least a part of the swashplate surface a coating layer comprising a thermoset polymer-metal composite coating of (1) 3–20 volume % polytetrafluoroethylene (PTFE), (2) 60–92 volume % resin binder, and (3) 1–20 volume % metal particles selected from the group consisting of chromium, iron, nickel, copper, molybdenum, aluminum, their alloys, and a mixture of any of them or their alloys, the amount of each such component being individually based on the total volume of the composite coating, the cured composite coating having a hardness of more than 6H; said coated part of the surface of said swashplate is in slideable contact with said shoes.

2. The swashplate compressor of claim 1, wherein said metal particulate comprises 2–18 volume % of said coating.

3. The swashplate compressor of claim 2, wherein said metal particulate comprise 2–15 volume % of said coating.

4. The swashplate compressor of claim 1, wherein said metallic particles have on average a diameter of 1–20 $\mu$m.

5. The swashplate compressor of claim 1, wherein said metallic particles are nickel or iron.

6. The swashplate compressor of claim 1, wherein said resin binder is polyamide-imide resin.

7. The swashplate compressor of claim 1, wherein said thickness of said coating is from 5 to 50 $\mu$m.

8. The swashplate compressor of claim 1, wherein said composite further comprises 0.5–20 volume % additive material including at least one member of the group consisting of adhesion modifier, solid lubricant, non-metallic hardness modified and corrosion inhibitor.

9. The swashplate type compressor of claim 1, wherein said matrix of said swashplate contains hard grains having an average particle diameter of from 10 to 100 micrometers and a hardness greater that 300 on the Vickers hardness scale.

* * * * *